US006272703B1

(12) United States Patent
Swezey et al.

(10) Patent No.: US 6,272,703 B1
(45) Date of Patent: Aug. 14, 2001

(54) ADJUSTABLE KNEE SUPPORT

(76) Inventors: Robert L. Swezey, 10532 Garwood Pl., Los Angeles, CA (US) 90024; Richard Swezey, 148 N. Wilton Pl., Los Angeles, CA (US) 90004

( * ) Notice: Subject to any disclaimer, the term of this patent is extended or adjusted under 35 U.S.C. 154(b) by 0 days.

(21) Appl. No.: 09/668,164

(22) Filed: Sep. 25, 2000

(51) Int. Cl.[7] ..... A47C 20/00
(52) U.S. Cl. ..... 5/648; 5/640; 5/643; 5/630
(58) Field of Search ..... 5/630, 632, 640, 5/643, 648, 650, 491

(56) References Cited

U.S. PATENT DOCUMENTS 1,452,915 * 4/1923 Kennedy ..... 5/648
2,991,126 * 7/1961 Deady ..... 5/648
3,842,453 * 10/1974 Redfield ..... 5/491
3,995,846 * 12/1976 Frick ..... 5/648
5,113,875 * 5/1992 Bennett ..... 5/648
5,824,013 * 10/1998 Allen ..... 5/643

* cited by examiner

*Primary Examiner*—Michael F. Trettel
(74) *Attorney, Agent, or Firm*—J. E. McTaggart

(57) ABSTRACT

A knee support pillow is configured with a main body disposed between a pair of end members configured to have an elliptical cam-shape cross-section that allows for variable height and support by rotating or adjusting the unit to provide any number of heights to comfortably support a user's knees and legs. The cam-shape is configured to provide handles built into the end members act as handgrips to facilitate easy gripping to rotate the unit forward and back to obtain an optimal comfort setting for the user. The user can position and adjust the support pillow while remaining in a seated or reclining position, and can re-adjust the support as needed to accommodate changing tasks or activities. An easily removable and replaceable fabric outer cover extends over the usable region of the main body.

4 Claims, 2 Drawing Sheets

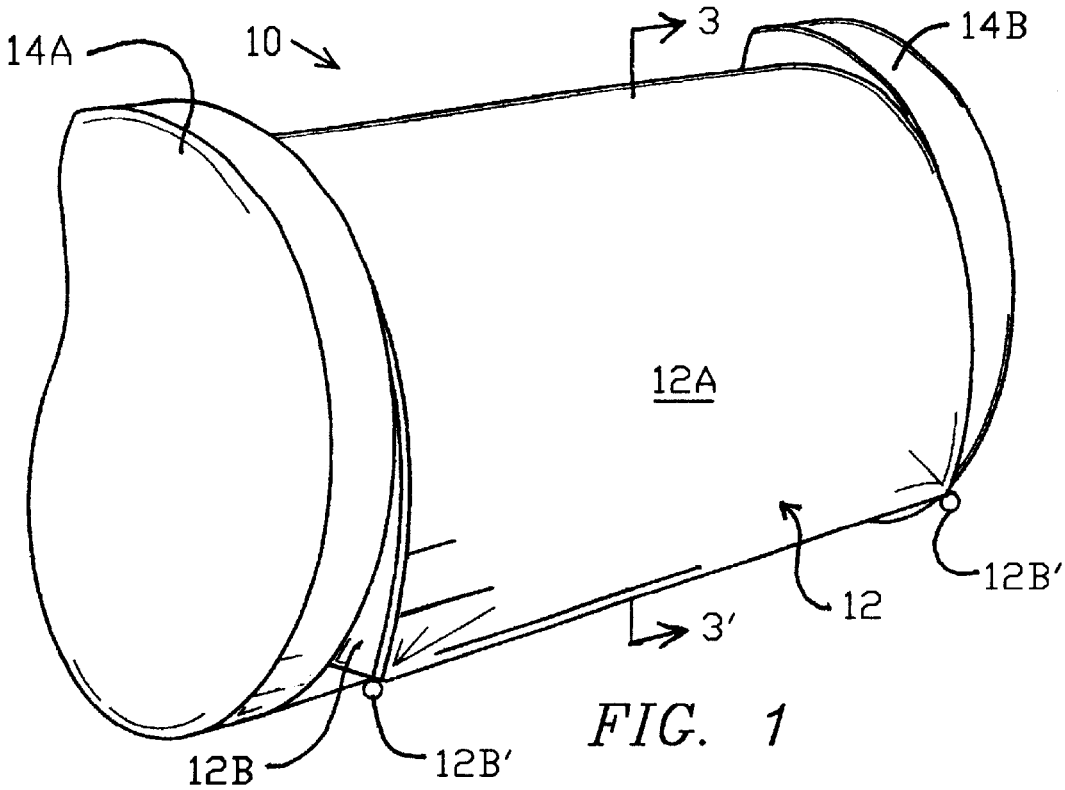
FIG. 1
FIG. 2A
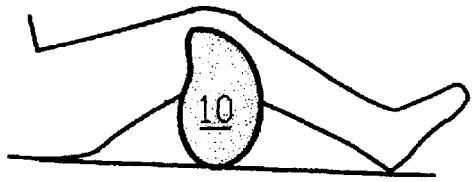
FIG. 2B
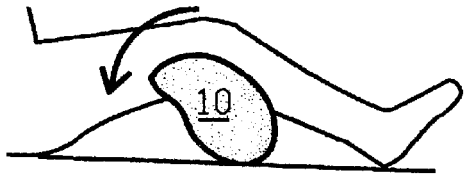
FIG. 2C
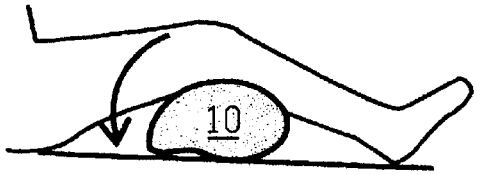

ADJUSTABLE KNEE SUPPORT

FIELD OF THE INVENTION

The present invention is in the field of physical therapy devices and more particularly it is directed to an ergonomic knee support pillow that can be adjusted to a variety of heights.

1. Background of the Invention

Knee supports can provide relaxing comfort and support to the knees in a sitting or reclining position, particularly in instances of recovery from injury, disease, fatigue, etc. Most knee supports and/or knee wedges must remain in one set position. Others require that material layer and/or additions be added or removed to fit user comfort needs. This means that the user must leave the seated or reclining position to add to and/or adjust the wedge or support. Most of the supports or wedges are configured in a shape that only allows one or two set heights, depending on the size of the wedge that is used.

2. Discussion of Known Art

U.S. Pat. No. 5,878,453 to Stokes discloses a pillow for alleviating lower back pain including an under-knee portion which holds an individual's knee in flexion when he is lying on his back, and a between-knee portion, which hold the individual's knees a spaced distance apart when he lying on his side. Adjustment is provided for the relative positions of the two portions to accommodate users of different sizes.

U.S. Pat. No. 5,871,457 to Swedberg discloses a modular knee positioning support having at least one leg-engaging portion removably attached to a center wedge portion.

OBJECTS OF THE INVENTION

It is a primary object of the invention to provide a knee support that allows for an infinite variety of heights to be selected by the user.

It is a further object that the knee support can be deployed with the user in a reclining or seated position.

It is a further object that the knee support can be adjusted by the user without having to leave the reclining or seated position.

SUMMARY OF THE INVENTION

The above mentioned objects have been accomplished in the knee support of the present invention of a knee support pillow configured with an elliptical cross-sectional shape that allows for variable height and support by rotating or adjusting the unit into any desired height to support users' knees and legs. Handles built into the end of the support pillow act as easily grasped handgrips to facilitate rotating the unit forward and back to obtain an optimal comfort setting for the user. The user can position and adjust the support pillow while remaining in a seated or reclining position, and can re-adjust the support as needed to accommodate changing tasks or activities.

BRIEF DESCRIPTION OF THE DRAWINGS

The above and further objects, features and advantages of the present invention will be more fully understood from the following description taken with the accompanying drawings in which:

FIG. 1 is a perspective view of a knee support pillow in a preferred embodiment of the present invention.

FIG. 2A–C are side views of the knee support pillow of FIG. 1 as deployed by a user at three different heights.

DETAILED DESCRIPTION

FIG. 1 is a perspective view of a knee support pillow 10 in a preferred embodiment of the present invention. A main body 12, typically made 20 inches long, is fastened between two cam-shaped end members 14A and 14B, typically made 1¾ inches thick. Around a major upper portion of the main body 12 an outer cover 12A encloses a feather pillow whose casing 12B is fitted with four fasteners 12B' that engage the four corners of outer cover 12A to hold it in place.

FIGS. 2A–2C are side views showing three different heights at which the knee support pillow 10 of FIG. 1 can be deployed by a user. The end profile shown is essentially the outline of the end members which are configured with a modified cam-shape that provides built-in handles that act as handgrips to facilitate easy gripping to rotate the unit forward and back to obtain an optimally comfortable setting for the user.

In FIG. 2A, support pillow 10 is positioned in a vertical orientation so as to provide maximum support height as determined by the maximum diameter of the main body 12: typically about six inches.

In FIG. 2B, support pillow 10 has been rotated counterclockwise about 45 degrees from the orientation of FIG. 2A as indicated by the arrow, so as to provide an intermediate knee support height.

In FIG. 2C, support pillow 10 has been further rotated counterclockwise to about 90 degrees from the position of FIG. 2A as indicated by the arrow, so as to provide minimum support height as determined by the minimum diameter of the main body 12: typically about three inches.

Figure 3:
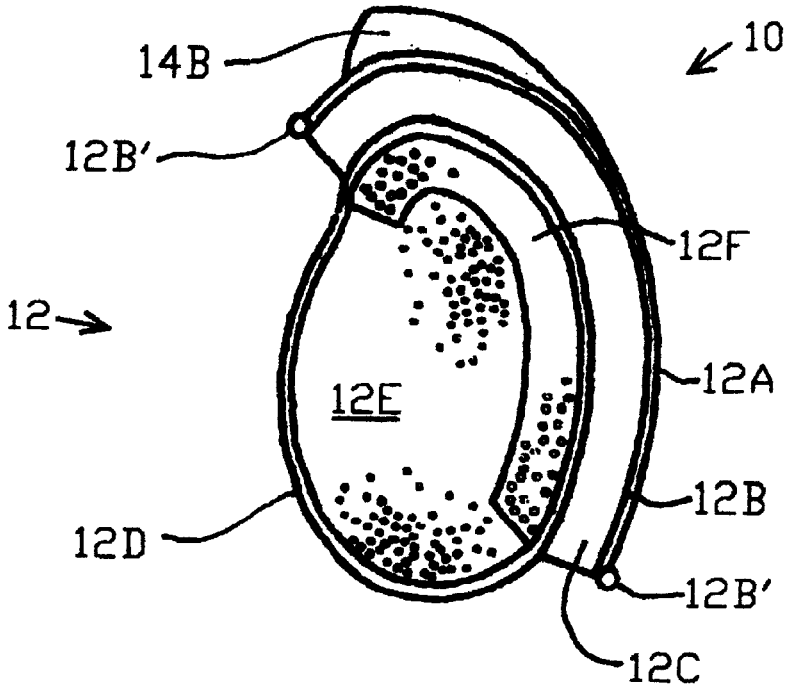
FIG. 3 is a cross-section taken through 3–3' of FIG. 1.

FIG. 3 is a cross-section of a preferred embodiment of the support pillow 10 of this invention taken through axis 3–3' of FIG.1, showing the main body 12 as having a composite multi-layer structure. In the upper padded portion, down or feather pillow material 12C is enclosed in pillow casing 12B, wrapping around the main body 12. Casing 12B is fitted with fasteners 12B' that engage the corners of outer cover 12A to hold it in its wrapped-around place for deployment, but allow it to be easily removed for laundering or replacement.

Main body 12 consists mainly of the major core member 12E, made of medium hard foam, contour cut or molded, upon which is placed a sector pad 12F of soft foam or down. As an option the main body 12 could be made to be of a self-inflating type such as that disclosed in U.S. Pat. No. 5.948,013, utilizing expanding foam and an air valve.

Figure 4:
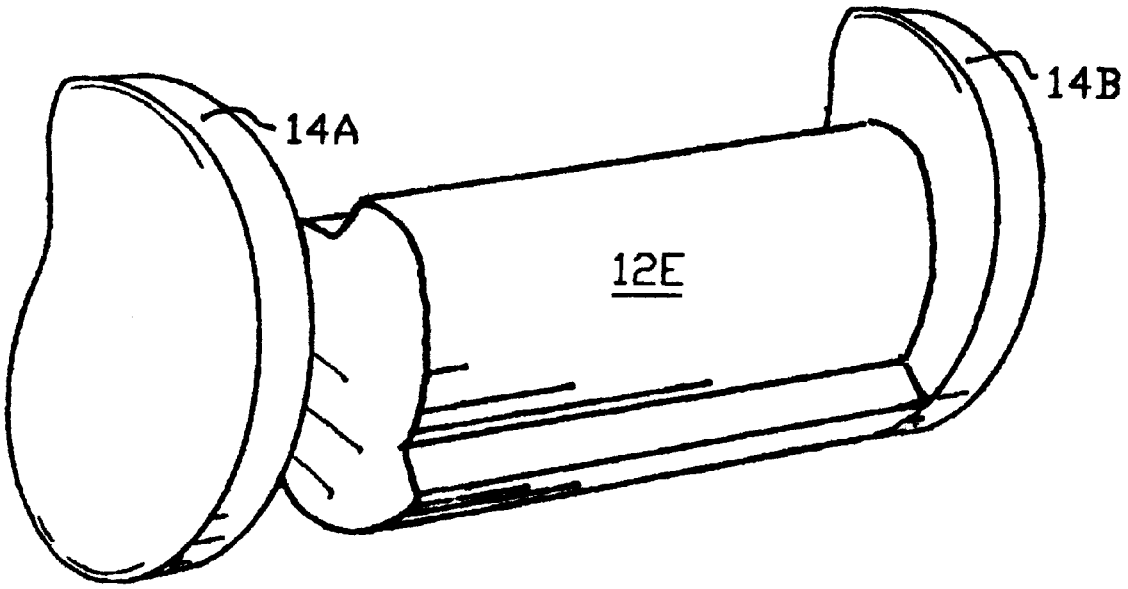
FIG. 4 is a perspective view of three principal components of the knee support pillow of FIGS. 1–3.

FIG. 4 is perspective view of three principal components of the knee support pillow 10 of FIG. 3: the major core member 12D, and the two cam-shaped end members 14A and 14B, shown respectively separated from and attached to the major core member 12D.

The invention may be practiced using various other types and/or densities of foam, fiber, as well as feather and down pillow material.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A knee support pillow for providing relaxing support to knees of an individual when disposed in a reclining position and when disposed in a sitting position, comprising;

a generally cylindrical main body having a relatively firm lower portion and a relatively soft and resilient upper portion;

a pair of end members attached to opposite ends of said main body, said end members having a generally elliptical shape that is elongated in a substantially vertical direction such that a user is enabled to adjust for different heights of knee support by rotating said support pillow to selected orientations of said elliptically-shaped end members while actually deploying said support pillow.

2. The knee support pillow as defined in claim 1 wherein said main body comprises:

a core of resilient material having a generally elliptical cross-sectional shape;

a pair of generally elliptical end members, affixed one to each end of said core located with bottom edges of said core and said end members substantially in alignment and top edges of said end members extending substantially beyond a top side of said core; and a soft pillow with a generally rectangular pillow casing affixed onto an upper region of said core in an approximately semicircular shape around said core.

3. The knee support pillow as defined in claim 2 wherein said core comprises:

a major lower portion made from relatively stiff foam material; and a minor upper portion made from relatively soft resilient foam material affixed onto said major lower portion.

4. The knee support pillow as defined in claim 1 further comprising:

a generally rectangular fabric outer cover disposed over the upper portion of said main body; and fastening means for removably holding said outer cover onto said main body.

* * * * *